US008110798B2

(12) United States Patent
Collings

(10) Patent No.: US 8,110,798 B2
(45) Date of Patent: Feb. 7, 2012

(54) METHOD FOR COOLING IONS IN A LINEAR ION TRAP

(75) Inventor: Bruce Collings, Bradford (CA)

(73) Assignee: DH Technologies Development Pte. Ltd., Singapore (SG)

( * ) Notice: Subject to any disclaimer, the term of this patent is extended or adjusted under 35 U.S.C. 154(b) by 458 days.

(21) Appl. No.: 12/359,563

(22) Filed: Jan. 26, 2009

(65) Prior Publication Data

US 2011/0174965 A1 Jul. 21, 2011

Related U.S. Application Data

(60) Provisional application No. 61/025,139, filed on Jan. 31, 2008.

(51) Int. Cl.
*H01J 49/04* (2006.01)

(52) U.S. Cl. ..... 250/292; 250/290; 250/282

(58) Field of Classification Search ..... 250/292, 250/281, 282, 290
See application file for complete search history.

(56) References Cited

U.S. PATENT DOCUMENTS 6,515,280 B1 2/2003 Baykut
6,683,301 B2 1/2004 Whitehouse et al.
6,875,980 B2 4/2005 Bateman et al.
6,888,134 B2 5/2005 Hashimoto et al.
6,960,762 B2 11/2005 Kawato et al.
7,189,963 B2 3/2007 Krutchinsky et al.
7,893,401 B2 * 2/2011 Ding ..... 250/288
2002/0195555 A1 * 12/2002 Weinberger et al. ..... 250/281

FOREIGN PATENT DOCUMENTS

WO WO2007/071991 A2 6/2007

OTHER PUBLICATIONS

PCT/CA2009/000085: International Search Report and Written Opinion, Mar. 13, 2009.

T.J. Carlin and B.S. Freiser, "Pulsed Valve Addition of Collision and Reagent Gases in Fourier Transform Mass Spectrometry", Analytical Chemistry, vol. 55, No. 3, Mar. 1983, pp. 571-578.

Brad I. Coppersmith and Richars A. Yost, "Internal Pulsed Valve Sample Introduction on a Quadrupole Ion Trap Mass Spectrometer", American Society for Mass Spectromtry, 1995, 6, pp. 976-980.

* cited by examiner

*Primary Examiner* — Kiet Nguyen

(57) ABSTRACT

Methods for cooling ions retained in an ion trap are described. In various embodiments, a cooling gas is delivered into a linear ion trap causing a non-steady state pressure elevation in at least a portion of the trap above about $8\times10^{-5}$ Torr for a duration less than the ion-retention time. In various embodiments, the duration of pressure elevation can be based upon a period of time required for an ion to lose a desired amount of its kinetic energy.

16 Claims, 8 Drawing Sheets

METHOD FOR COOLING IONS IN A LINEAR ION TRAP

This is a non-provisional application of U.S. application No. 61/025,139 filed Jan. 31, 2008. The contents of U.S. application No. 61/025,139 are incorporated herein by reference.

INTRODUCTION

Ion-confining instruments, commonly known as ion traps, are useful for the study and analysis of ionized atoms, molecules or molecular fragments. In the field of mass spectroscopy, an ion trap is often combined with one or more mass spectrometers, and the trap can be used to retain and cool the ions prior to their ejection into the mass spectrometer for analysis. The mass spectrometer separates ions according to mass, and generates signals representative as mass spectral peaks, each having a magnitude proportional to the number of ions detected at a particular mass. In this manner, one can determine the relative and absolute abundances of known atoms, molecules and molecular fragments present in an ionized gas derived from a sample of unknown chemical makeup. Such information is useful in the fields of chemistry, pharmacology, biological systems, medicine, security, and forensics.

The ion-cooling process, a process by which the ions lose kinetic energy while retained in the trap, improves the resolution of the subsequent mass spectrometry. A collection of ions having a mean-kinetic-energy value more than several electron volts (eV), will also have a distribution of kinetic-energy values. It is this distribution or spread in kinetic energies that undesirably manifests itself as a spread in mass values in the mass spectrometer. Consequently, the width of the mass spectral peaks broaden, and their magnitudes diminish for energetic ions. Two different ions having nearly equal mass can be misidentified as a single ion if their broadened spectral peaks substantially overlap. Cooling the ions sharpens the mass spectral peaks, improves the measurement resolution, and increases the accuracy of the analysis.

For one particular type of ion trap, a linear ion trap (LIT), the ion-cooling period typically lasts from 50 to 150 milliseconds. This cooling period represents a delay in data acquisition: the instrumentation must sit idle while the ions lose excess kinetic energy and cool. In some modes of operation, hundreds of scans must be done for a single sample type to increase the signal-to-noise ratio to a desired level. For these measurements, the ion-cooling time represents an undesirably long segment of data-acquisition time.

SUMMARY

In various aspects, the present teachings provide methods for cooling energetic ions retained in a linear ion trap. While the ions are retained in the trap, a cooling gas of neutral molecules is delivered into the trap so that molecules of the cooling gas can absorb some or most of the ions' kinetic energy. The interaction between the neutral molecules and the ions can accelerate the cooling rate of the ions. In various embodiments, the cooling gas is delivered for a brief duration of time using a pulsed gas valve. Subsequently, the gas can be evacuated and the pressure within the LIT can be restored to a lower value suitable for mass selection by axial ejection of ions from the trap.

In various embodiments, a method for cooling energetic ions retained in an ion-confining apparatus comprises multiple steps. These steps can include, but are not limited to, (1) trapping and retaining a collection of ions within the ion-confining apparatus for a retention time, (2) delivering a cooling gas into the ion-confinement apparatus during the retention time to raise the pressure in at least a portion of the ion confinement apparatus above about $8\times10^{-5}$ Torr for a predetermined duration that is less than the ion retention time, (3) creating for at least a portion of the retention time a non-steady state pressure in the ion-confinement apparatus, and (4) ejecting the ions from the ion-confinement apparatus at the end of the retention time.

In various embodiments, methods of cooling ions are carried out in a quadrupole linear ion trap (LIT) adapted with apparatus for delivery of a cooling gas of neutral molecules. The delivery apparatus can include one or more high-speed pulsed valves with pre-selected nozzles. The delivery apparatus can create a plume of gas impinging on the ion-confining region within the LIT. The plume of gas can create a spatial-density distribution of the delivered neutral molecules in at least a portion of the ion trap. In various embodiments, the delivered cooling gas elevates the pressure in at least a portion of the ion-confinement apparatus above about $8\times10^{-5}$ Torr for a predetermined duration of time that is less than about 50 milliseconds.

In various embodiments, a predetermined duration of time during which the pressure is elevated above a desired level depends upon the mass of the ions. Ions of greater mass generally require a longer duration of pressure elevation than lighter ions.

In various embodiments, the pre-desired amount of kinetic energy to be lost by the ions during the cooling process is greater than about 99% of their initial kinetic energy value, and the predetermined duration of pressure elevation is chosen to be within a range of about 85% and 115% of the time period required for this amount of energy to be lost. In various embodiments, the pre-desired amount of kinetic energy to be lost by the ions is the amount of energy that exceeds about 115% of the ambient kinetic-energy value, and the predetermined duration of pressure elevation is chosen to be within a range of about 85% and 115% of the time period required for this amount of energy to be lost.

In various embodiments, the delivered cooling gas can be comprised of one or more of the following: hydrogen, helium, nitrogen, argon, oxygen, xenon, krypton, and methane.

In various embodiments, the pressure within the linear ion trap restores to a lower value after terminating the delivery of the cooling gas. Ions can then be efficiently ejected from the ion trap using mass selective axial ejection. For example, in various embodiments the pressure restores to a range between about $2\times10^{-5}$ Torr and $5.5\times10^{-5}$ Torr during the ejection of the ions from the ion-confinement apparatus.

In various embodiments, the pulsed valve can be pulsed intermittently while ions are added into the linear ion trap. For example, collision gas can be introduced into the LIT by, e.g., opening a pulsed valve for a fill duration of about 5 milliseconds about every 50 milliseconds. In various embodiments, gas is intermittently pulsed into the LIT to provide a substantially linear relationship between the number of ions retained by the trap and the amount of time the valve is open.

The foregoing and other aspects, embodiments, and features of the present teachings can be more fully understood from the following description in conjunction with the accompanying drawings. In the drawings, like reference characters generally refer to like features and structural elements throughout the various figures. The drawings are not necessarily to scale, emphasis instead being placed upon illustrating the principles of the teachings.

BRIEF DESCRIPTION OF THE DRAWINGS

The skilled artisan will understand that the drawings, described herein, are for illustration purposes only. The drawings are not intended to be to scale. In the drawings the present teachings are illustrated using a quadrupole linear ion trap, but other types of ion traps, including but not limited to hexapole linear ion traps, multipole linear ion traps, and ion-cyclotron resonance ion traps, can be used. The drawings are not intended to limit the scope of the present teachings in any way.

DETAILED DESCRIPTION OF VARIOUS EMBODIMENTS

The teachings presented herein pertain in various aspects to methods for cooling energetic ions retained in a linear ion trap. In various embodiments, the cooling rate of ions can be accelerated by delivering a cooling gas of neutral molecules into the trap for a predetermined duration of time. The delivered neutral molecules can interact with the energetic ions, and absorb some of the ion's kinetic energy. The delivered gas can cause a pressure elevation within the trap above $8\times10^{-5}$ Torr, and create a non-steady state pressure within the trap. In various embodiments, the predetermined duration of neutral-gas delivery can be substantially matched to the time period for the ions to lose a predetermined amount of their kinetic energy. Once the ions' kinetic energy reduces to a desired level, the neutral gas can be evacuated and the ions ejected from the trap. The methods described herein, in various embodiments, can enable more rapid cooling of ions than would be obtained without delivery of a cooling gas.

Figure 1:
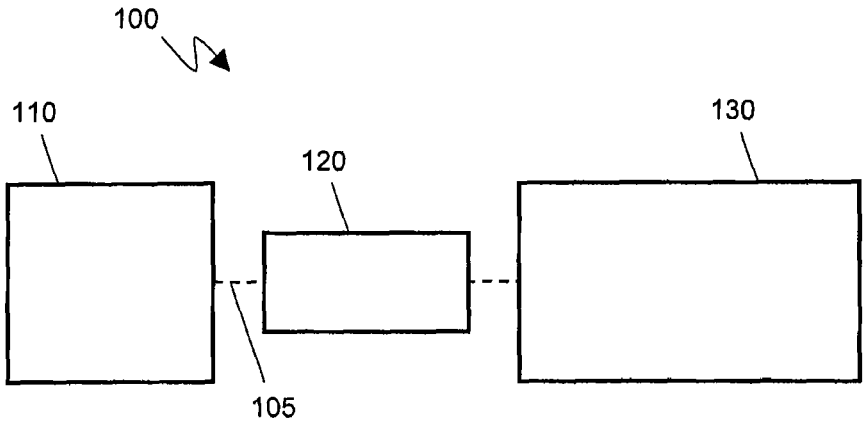
FIG. 1 is a block diagram of an ion-analysis instrument having a linear ion trap (LIT).

Ion traps are useful for the analysis and determination of ion species present in a gas of ions. For purposes of understanding, a generic ion-analysis instrument 100 having, in various embodiments, a quadrupole linear ion trap (LIT) 120, an ion pre-processing element 110, and an ion post-processing element 130 is shown in FIG. 1. In various embodiments the pre-processing element 110 can be an ion source or a mass spectrometer, and the post-processing element 130 can be a mass spectrometer, a tandem mass spectrometer or an ion-detection apparatus.

Ions can be created and prepared in gas form, or selected, within the pre-processing element 110, and then moved substantially along an ion path 105 into the quadrupole LIT 120. The LIT can be used to spatially constrain the ions, and to retain them for a period of time. During this retention time, one or more ion-related operations can be performed. In various embodiments, these operations can include, but are not limited to, electrical excitation, fragmentation, selection and cooling. Subsequent to the retention time, the ions can be ejected from the LIT into the ion post-processing element 130, which for example may be a mass spectrometer. The ejection of the ions from the LIT can occur, for example, via mass selective axial ejection (MSAE).

In practice, the chambers within the LIT 120 and the post-processing element 130 are typically under vacuum, and the ion path 105 is under vacuum. In various embodiments, the steady-state background pressure existing in the LIT 120 before injection of a cooling gas is less than about $5\times10^{-5}$ Torr. Upon ejection of ions from the trap, the pressure can between about $2\times10^{-5}$ Torr and about $5.5\times10^{-5}$ Torr, so that the MSAE can be performed efficiently.

Although a quadrupole linear ion trap is described in conjunction with FIG. 1, other types of ion traps may be used in combination with the methods, or modifications of the methods, taught herein. Other types of ion traps include, but are not limited to, ion cyclotron resonance (ICR) traps, hexapole linear ion traps, and multipole linear ion traps.

Figure 2A:
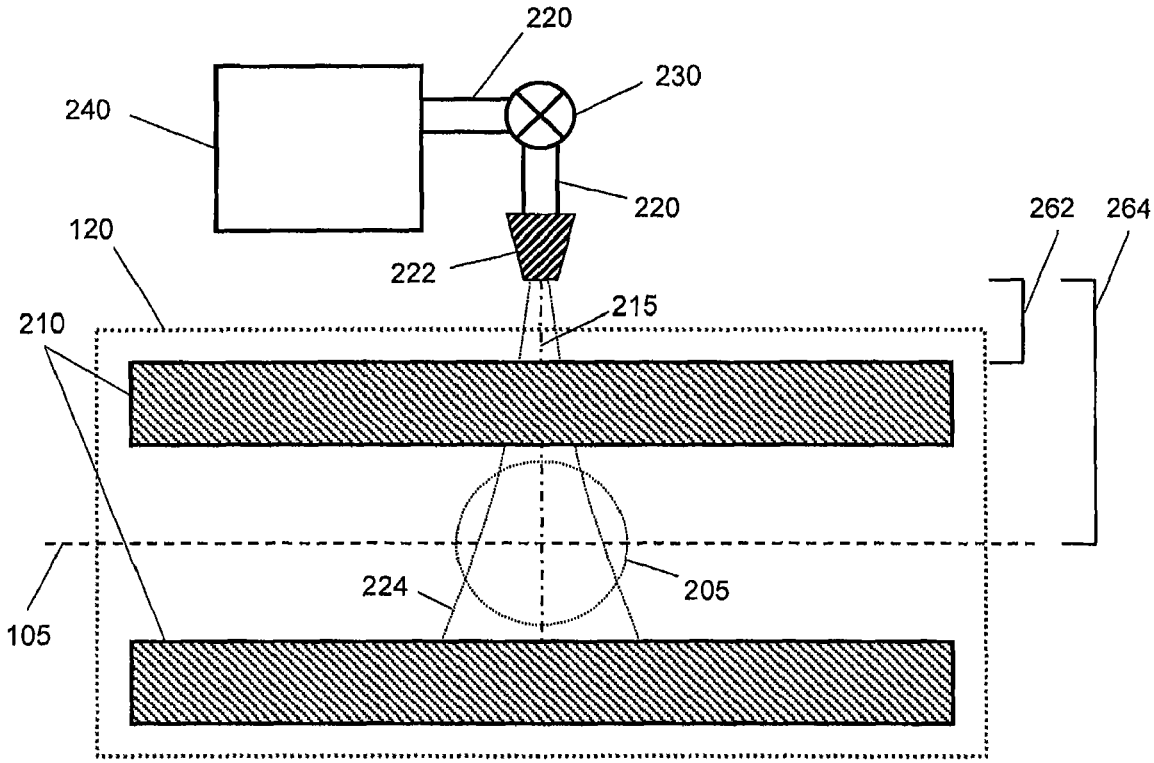
FIG. 2A is an elevational side view depicting a quadrupole linear ion trap, and apparatus to inject a gas into the trap.
Figure 2B:
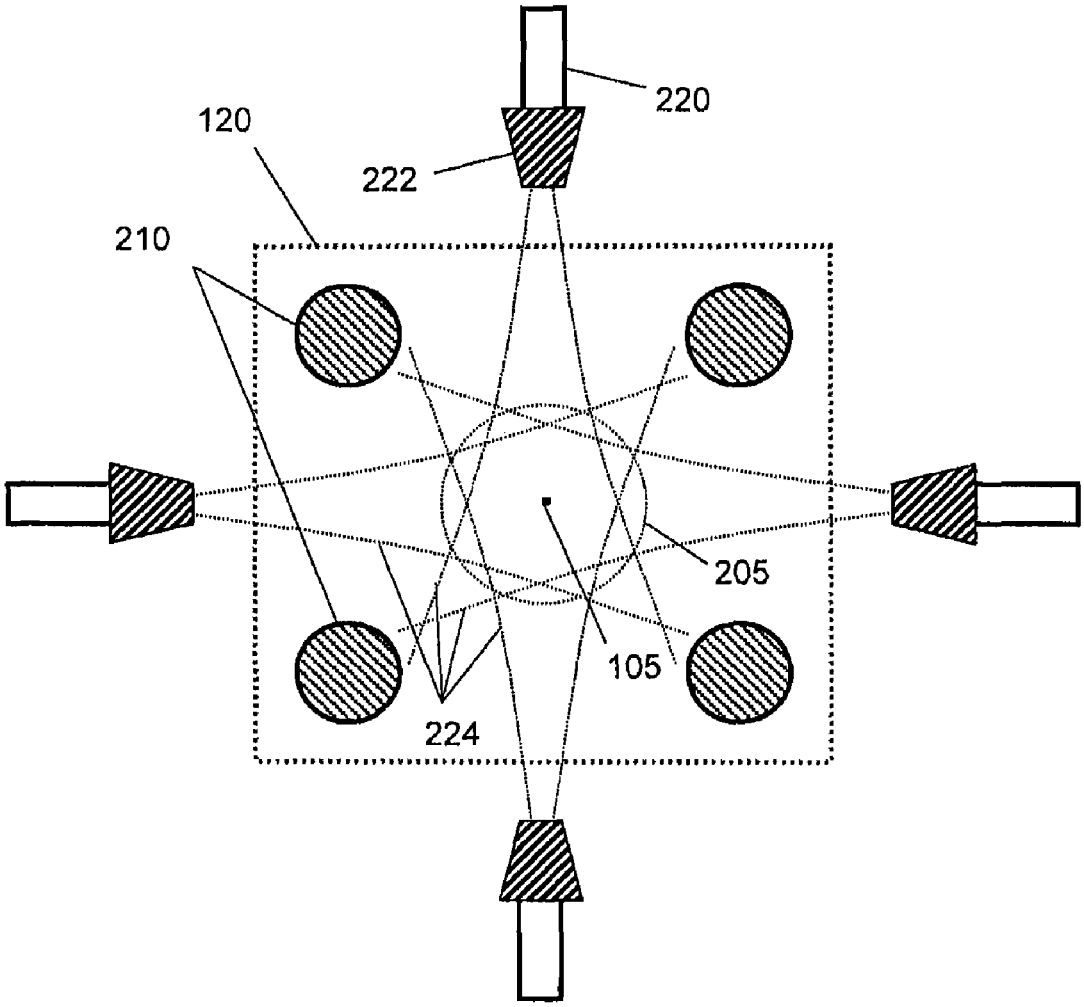
FIG. 2B is an elevational end view of the quadrupole trap portrayed in FIG. 2A. Three gas-injecting nozzles have been added to the drawing to depict various embodiments.

Some internal components of a quadrupole LIT 120 are depicted in various embodiments in FIGS. 2A-2B. Four conductive rods 210 run parallel to the ion path 105. Electric potentials, with DC and AC components, can be applied to the rods 210 and end caps (not shown), creating an electric field which spatially confines ions to an ion-confinement region 205 within the trap. Ions entering the trap and moving along the path 105 can be captured and retained for a retention time in the ion-confining region 205.

Additional apparatus comprising gas supply element 240, tubing 220, a pulsed valve 230, and a gas-injection nozzle 222, also illustrated in FIGS. 2A-2B, can be added to the LIT 120 to increase the cooling rate of ions confined within the LIT in accordance with the various embodiments and methods disclosed herein. In various embodiments, the pulsed valve can be of the type supplied by the Lee Company, Westbrook, Conn., U.S., model number INKA2437210H, having a response time of 0.25 ms, a minimum pulse duration of 0.35 ms, and an operational lifetime of $250\times10^6$ cycles. Referring to FIG. 2A, in various embodiments, the nozzle can be located a distance $d_1$ 262 from the rods 210 and a distance $d_2$ 264 from the center of the ion-confining region 205. In various preferred embodiments $d_1$ is approximately 10 mm and $d_2$ is approximately 21 mm.

The design and position of the gas-injection nozzle 222 have been studied by the inventors. As gas is ejected from the nozzle 222 it creates a conically-shaped plume 224 as indicated in FIG. 2A. This plume represents the boundary of a certain gas density of the injected gas molecules, i.e. a spatial-density distribution, within the LIT. In various embodiments, the apparatus added for gas injection can be located on the LIT 120 such that the plume 224 substantially overlaps the ion-confinement region 205, permitting efficient intermixing of the injected molecules with the trapped ions. Further, the nozzle itself can be designed to deliver a predetermined plume shape, and positioned as near as possible to the ion-confinement region 205.

Figure 3A:
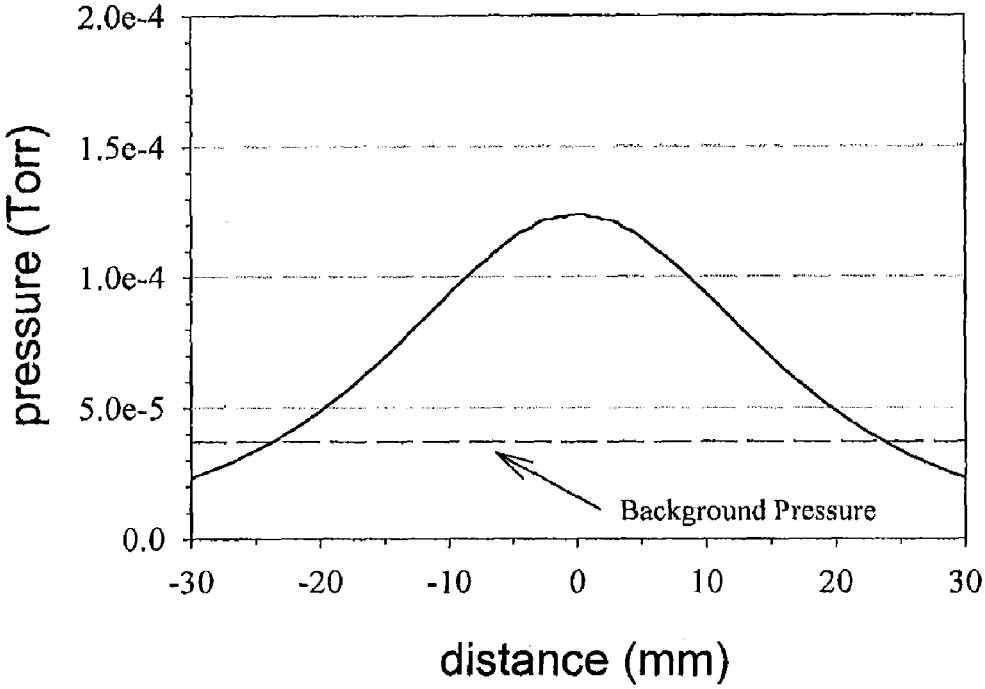
FIG. 3A is a plot of the spatially-varying pressure distribution created by the plume of injected cooling gas within the LIT. This plot corresponds to a direction transverse to the flow of injected molecules.
Figure 3B:
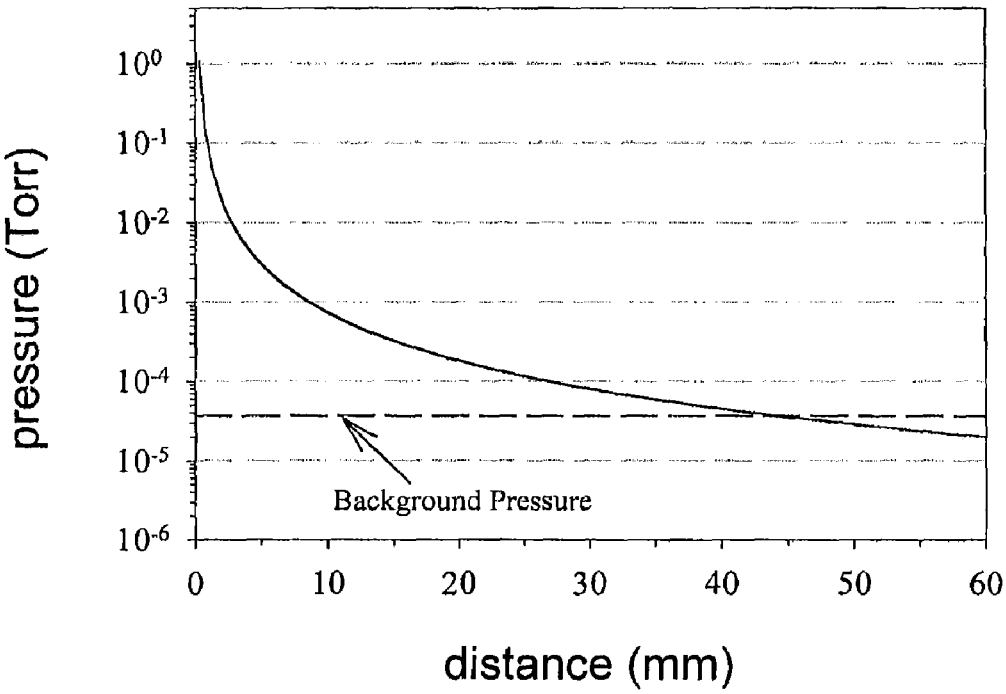
FIG. 3B is a plot of the spatially-varying pressure distribution created by the plume of injected gas within the LIT. This plot corresponds to a direction collinear with the flow of injected molecules.

Details of the spatial-density distribution, or plume shape 224, of the injected molecules are given in the theoretical plots of pressure shown in FIGS. 3A-3B, representing one of many possible embodiments of the gas-injecting apparatus. The density of the injected molecules within the LIT 120 have been estimated using equations developed for free jet expansions. For this estimate the nozzle is located at approximately $d_2$=25 mm from the center of the ion-confinement region 205. The pressure profiles shown in the plots are calculated from the molecular spatial-density profiles assuming the injected gas is at standard temperature, 273.15 K. The dashed line in the figures represents the background pressure present in the LIT before injection of the cooling gas.

FIG. 3A shows the transverse or radial pressure profile calculated for this illustrative embodiment at a distance of $d_2$=25 mm from the aperture of the nozzle 222. The pressure tails off to either side of the plume axis, 215 of FIG. 2A, until it reaches the lower limit of the chamber's background pressure. The highest pressure at a given distance from the nozzle 222, or highest density of injected molecules at a given distance, lies on the plume axis 215. In various embodiments, the plume axis 215 centrally traverses the ion-confinement region 205.

FIG. 3B shows a calculated axial pressure profile of the gas jet that is emitted from the nozzle, for the same illustrative embodiment of FIG. 3A, once the flow has been established. The horizontal axis corresponds to the distance along the plume axis 215. The background pressure is about $3.7\times10^{-5}$ Torr. This pressure is too low to support shock wave structures normally associated with a free jet expansion. The background pressure then becomes the minimum pressure that the axial profile will attain. From FIG. 3B it can be seen that the peak pressure in the ion-confining region 205 can be more than 3 times that of the background pressure within the LIT when the nozzle 222 is located a distance $d_2$=21 mm from the center of the region 205.

FIG. 2B illustrates one of many various embodiments for locating cooling-gas injection nozzles. As shown, multiple gas-injection nozzles can be distributed around the ion-confining region 205 in a symmetric manner. Accordingly, any distortion of the ion-confining electric fields due to the nozzles occurs symmetrically. In various embodiments this reduces the distances $d_1$ 262 and $d_2$ 264, which would increase the pressure within the ion-confining region in accordance with FIG. 3B. In various embodiments the average velocity of all injected gas molecules would be zero, reducing potential deleterious effects of a net flow velocity that may knock weakly-trapped ions out of the trap.

The effect that the injected cooling gas of neutral molecules has on the cooling rate of ions retained in the LIT 120 may be understood from the following. The cooling rate of an energetic ion can be proportional to its collision frequency z, and can also be proportional to the pressure of the collision gas. This can be seen from the relation $$z = \frac{v_{rel}\sigma N}{V} \tag{1}$$

where σ is the collision cross section in Å$^2$, N/V is the density of the injected neutral molecules and $v_{rel}$ is the relative collision velocity of the ion and the neutral molecule. Since pressure is proportional to N/V, the ion-cooling rate is proportional to pressure. Thus, an increase in pressure of the cooling gas within the ion-confining region 205 can increase the ion-cooling rate.

For elastic (hard sphere) scattering the energy of the ion after the n collisions, $E'_{lab}(n)$ is given by $$E'_{lab}(n) = E_{lab}\left(\frac{(m_1^2 + m_2^2)}{(m_1 + m_2)^2}\right)^n \tag{2}$$

where $m_1$ and $m_2$ are the masses of the collision partners and n is the number of collisions suffered by the ion. This expression ignores the thermal velocity distribution of the ion and becomes inaccurate as $E_{lab}$ approaches thermal kinetic energies. It can be seen that in this simple model the required final kinetic energy of the ion depends upon the ion having the same number of collisions at each pressure. Eqns. (1) and (2) ignore the effects of any radio-frequency confinement fields used in the LIT. These fields will impart additional kinetic energies into the ion and their effects are more easily examined through numerical simulation.

A wide variety of gases can serve as a cooling gas including, but not limited to, hydrogen, helium, nitrogen, argon, oxygen, xenon, krypton, and methane. Center-of-mass calculations show that the heavier collision gases are more efficient at removing kinetic energy from an ion while lighter gases are less efficient, e.g. a light-molecule injected gas would require a longer cooling period than a heavy-molecule gas.

The effect that the neutral molecules have upon energetic ions within the LIT can be observed from theoretical simulations of changes in the ion's kinetic energy calculated as a function of time for two cases: cooling in a neutral gas at a background pressure of $3.5\times10^{-5}$ Torr, cooling at an elevated pressure of $1\times10^{-4}$ due to the gas injection. The results from such simulations, based upon Eqn. (2), are plotted in FIGS. 4A-4B for ions of two different masses and charge states: 2,800 Da, charge state +1 (FIG. 4A); 16,950 Da, charge state +10 (FIG. 4B). The low-pressure results are plotted as open circles, and the high-pressure results are plotted as filled circles. The high-pressure results correspond to injection of a gas of neutral molecules into the LIT. For these simulations, parameters corresponding to a nitrogen cooling gas were used.

For the case shown in FIG. 4B, the ion's initial kinetic energy is 10 eV, and the ion is contained within a radial trapping field at a q value of 0.12. The q value, also known as the Mathieu parameter, is representative of the ion-trapping potential for a particular ion trap, and is proportional to the ratio $$\frac{V_{rf}}{(m/z)}$$

where $V_{rf}$ is the amplitude of RF trapping voltage applied to electrodes in the trap, and m/z is the mass-to-charge ratio of the trapped ions. It can be seen from FIG. 4A that the kinetic-energy value of the ion at a time of 100 ms and for a pressure of $3.5\times10^{-5}$ Torr can achieved in only 35 ms when the pressure is increased to $1.0\times10^{-4}$ Torr. The resulting factor of about a threefold increase in the cooling rate corresponds to the ratio of the pressures, and represents a significant reduction in the ion-cooling period.

The same effect is observed for the heavier, 16,950 Da, ion with a +10 charge state and 100 eV of initial kinetic energy, as shown in FIG. 4B. Ions with high charge states have kinetic energies proportional to the charge state times the potential energy difference that the ion experiences upon entering the LIT. Ions of this nature require even longer periods of time to cool to acceptable kinetic energies for good MSAE performance.

Figure 4A:
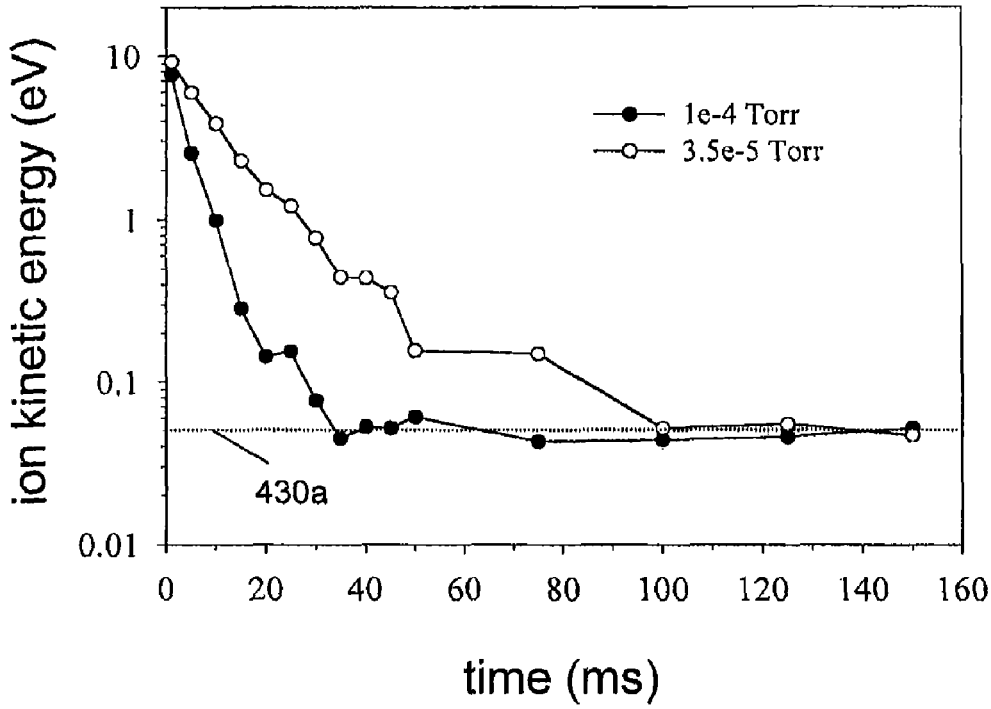
FIG. 4A is a plot of ion kinetic energy as a function of time, or cooling period, for two pressures within the cooling chamber. This data was calculated for a 2,800 Da, +1 charge-state ion.
Figure 4B:
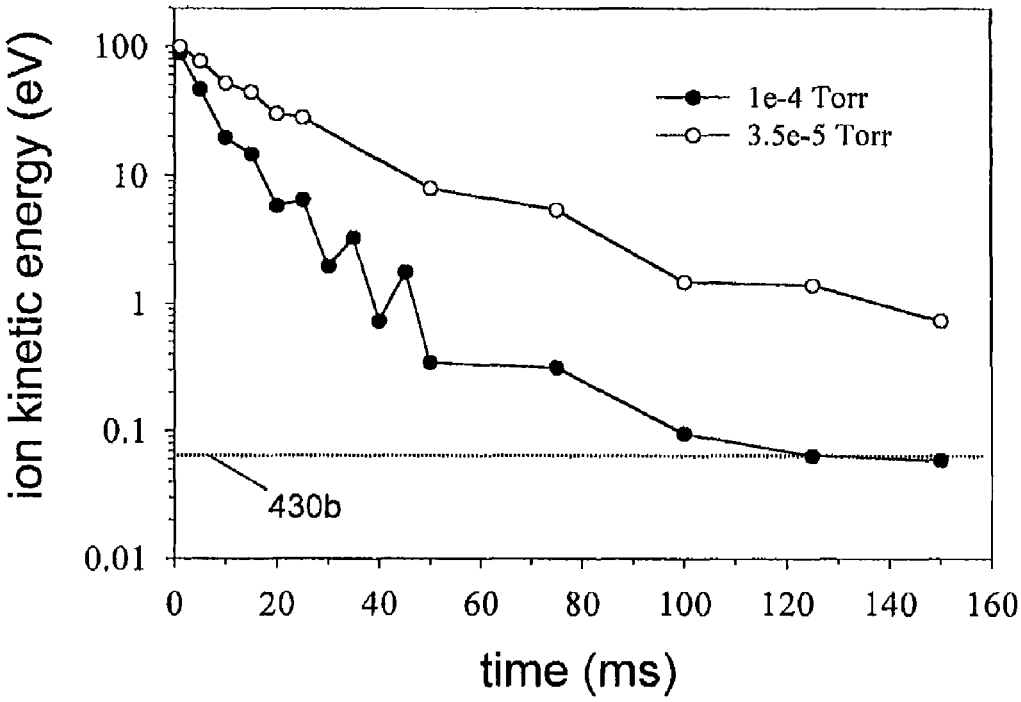
FIG. 4B is a theoretical plot of ion kinetic energy as a function of time for two pressures within the cooling chamber. This data was calculated for a 16,950 Da, +10 charge-state ion.

For the simulated cases of FIGS. 4A-4B, the increased rate of kinetic energy loss, increased rate of cooling, becomes evident when comparing the elevated pressure cases to the corresponding lower pressure cases. In both cases, the ion's kinetic energy decreases from a peak value until it approaches a base energy level, or ambient kinetic energy level, depicted by the dashed lines 430*a*, 430*b*. The value of the ambient level will be determined by parameters related to the trapping conditions for the particular ion, for example, background pressure, temperature, and amplitude and frequency of ion-trapping fields. In practice, the ambient level can be higher or lower than that indicated in FIGS. 4A-4B.

Referring to FIGS. 4A-4B, in various embodiments, the predetermined duration of time, during which the pressure within the LIT is elevated above a pre-desired value, can be chosen to be about equal to the time it takes for the ion to lose its kinetic energy in excess of the ambient energy level. For example, in various embodiments the predetermined duration is about 30 ms (gas injection for 20 ms followed by a 10 ms post-injection delay) for the case of FIG. 4A, and about 60 ms for the heavy ion case of FIG. 4B. Limiting the predetermined duration of pressure elevation within the LIT, e.g. by limiting the duration of the cooling gas delivery, increases the speed at which the pressure can be restored to a lower background level. Rapid restoration of pressure to a low background level can, in various embodiments, increase the duty cycle of a measurement by decreasing the time associated with ion cooling.

An ion cooling time can depend upon one or more of the following parameters: pressure of the collision gas, mass of the molecules comprising the collision gas, collision cross section, mass of the ion, charge of the ion, polarizability of the molecules comprising the collision gas, and trapping potential applied to the trap. For a particular ion under study, the ion cooling time can be derived approximately from numerical simulations, determined experimentally, or obtained from a combination of both approaches. Once the ion cooling time has been determined, the predetermined duration for elevation of pressure within the ion-confinement region can be based upon the ion cooling time. For example, in various embodiments the predetermined duration can be about equal to the ion cooling time. In various embodiments, the predetermined duration can be in a range between about 85% and 115% of the time interval during which the mean kinetic energy for ions in the trap reduces to less than about 1% of their peak mean kinetic energy value attained while in the trap. In various embodiments, the predetermined duration can be in a range between about 85% and 115% of the time interval during which the mean kinetic energy for ions in the trap reduces to less than a value that is about 15% greater than the ambient kinetic energy value for the ions in the trap.

Figure 5A:
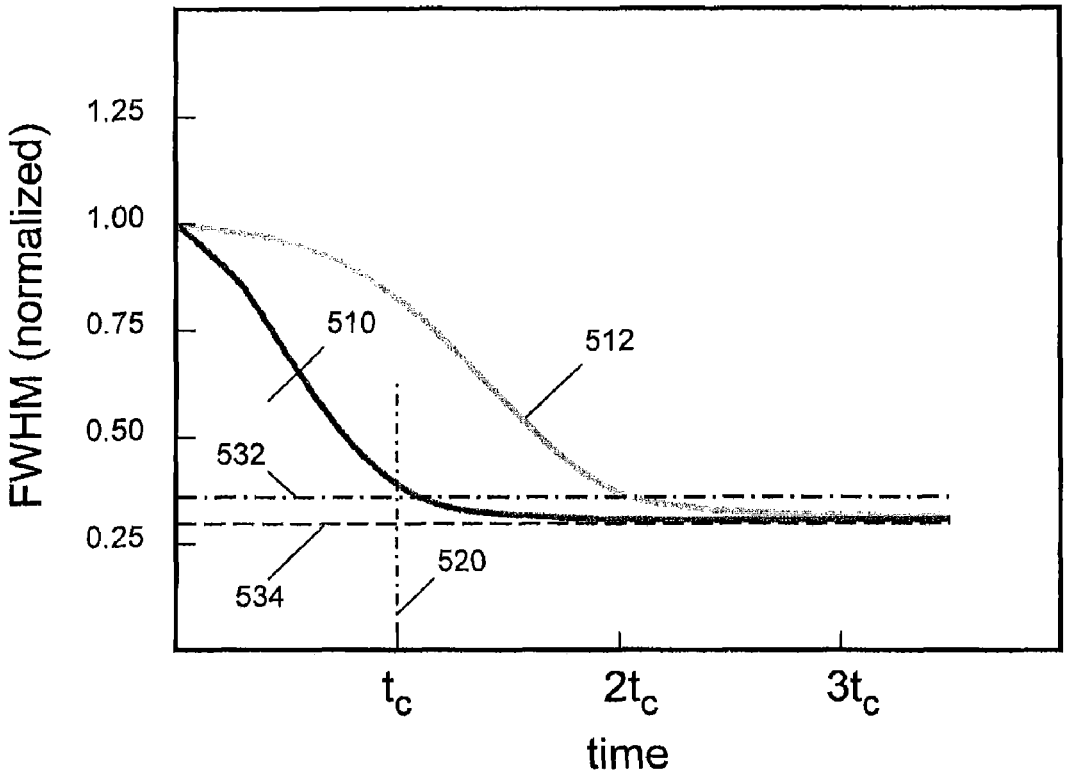
FIG. 5A is an illustrational plot comparing the full-width-half-maximum (FWHM) value of mass spectral peaks as a function of time for gas-injected cooled (dark curve) and traditionally cooled (light curve) ions.

A reduction of the ions' kinetic energy can contribute to a narrowing of the mass spectral peaks observed from subsequent analysis of the ions with a mass spectrometer. Excess ion kinetic energy can cause an energy-dispersive broadening of the mass spectral peaks, generally an undesirable result in mass spectroscopy. Examples of spectral narrowing are illustrated in FIG. 5A. This plot portrays the full-width-half-maximum (FWHM) value of an ion's spectral distribution, hypothetically measured in a mass spectrometer, as a function of cooling period. Generally, as the ion cools its kinetic energy distribution narrows and the resulting FWHM value decreases. Without gas-injected cooling, light-shaded curve 512, the resulting FWHM value reduces over time to a final value indicated by the line 534. With gas-injected cooling, curve 510, the FWHM value decreases more quickly, permitting more rapid ejection of the ion from the trap for mass spectroscopy.

Experimental measurements of ions' FWHM spectral value as a function of cooling time, with and without gas injection, show the trends indicated in FIG. 5A. The experimental results are reported in FIG. 5B for the ion 922 m/z. Data was generated for this ion for two cases: with the ions entering the LIT having axial kinetic energies of 2 eV, and having energies of 8 eV. Data was also generated with and without the injection of the cooling gas of neutral molecules. The circles represent data for a constant pressure of $3.5\times10^{-5}$ Torr, i.e. no injection of the cooling gas. Without gas injection the time required for the FWHM spectral values to reduce to about their final value is approximately 75 ms. With gas injection the time to reach a comparable FWHM value is less than 30 ms. In the experiment, the gas injection lasted 20 ms, and was followed by a 10 ms post-injection delay. At the termination of the 10 ms delay, ions were ejected via MSAE for mass spectroscopy. Although the peak pressure within the ion-confining region was not directly measured, the average pressure in the instrument did not exceed $9.5\times10^{-5}$ Torr for this experiment. The experimental result demonstrates that a reduction in the instrument's ion-cooling phase of at least about 45 ms or about 60% is possible by gas-injected cooling of the trapped ions.

Figure 5B:
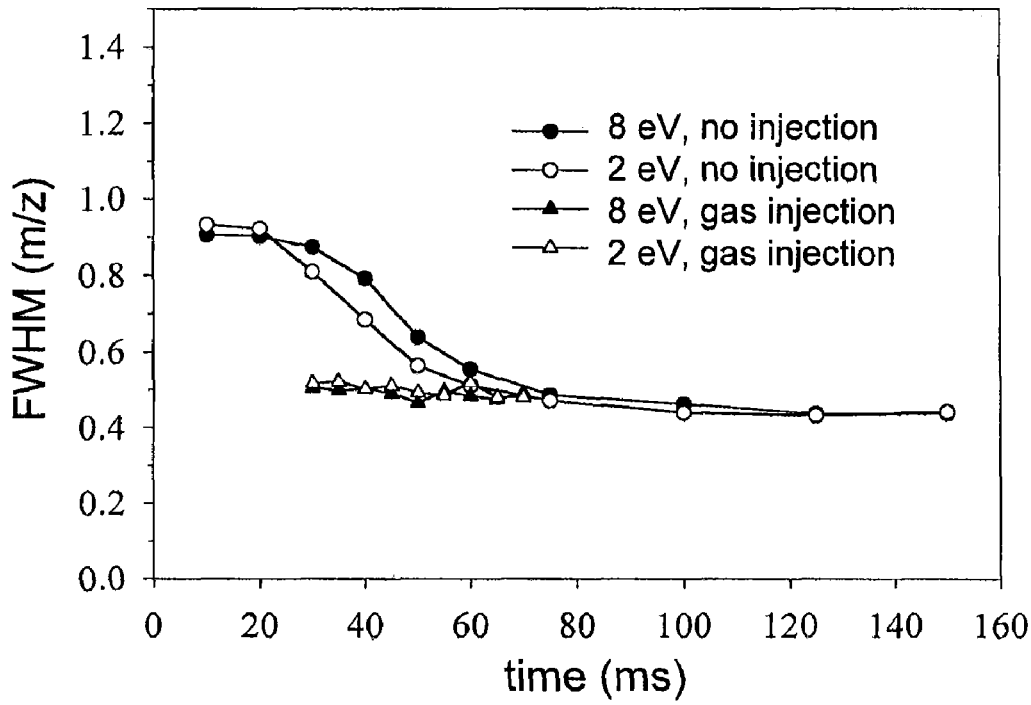
FIG. 5B is a plot of experimental data showing the full-width-half-maximum value (FWHM) of mass spectral peaks as a function of time for gas-injected cooled (triangles) and traditionally cooled (circles) ions having two different initial kinetic energies (filled symbol vs. open symbol).

FIG. 5B also indicates that ions entering the LIT at lower kinetic energies cool faster. This difference is shown in a comparison of the 8 eV ions (axial kinetic energy, solid circles) and the 2 eV ions (axial kinetic energy, open circles).

In FIG. 5B the front portion of the curve for the gas-injected case was not measured. This is due to a resulting, time-varying pressure elevation throughout the entire instrument. The ejection efficiency of ions from the trap at high pressures can be low. The delay occurring after terminating the injection of the cooling gas, for the cases reported in FIG. 5B, was used to restore the pressure within the mass spectrometer to a pre-desired value for efficient ejection of the ions from the trap. In various embodiments, the pulsed valve 230 and nozzle 222 are located in close proximity to the ion-confining region 205 within the LIT, so as to reduce the total amount of injected gas for a desired pressure elevation within the ion-confining region.

Figure 6A:
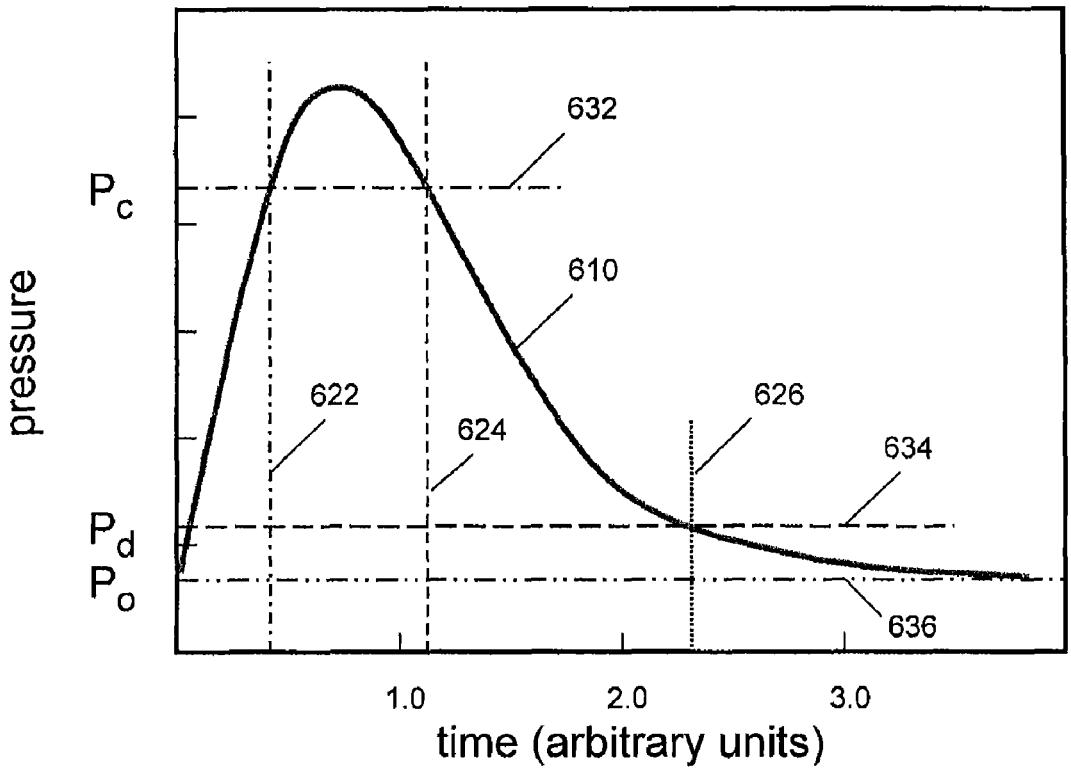
FIG. 6A is an illustrational plot representing the non-steady-state pressure in the ion-confinement space during and after injection of the cooling gas.

The non-steady state pressure, occurring within at least a portion of the LIT during and after injection of the cooling gas, is illustratively plotted as curve 610 in FIG. 6A. In various embodiments, at time t=0, the gas of neutral molecules can be injected into the LIT for a gas-injection duration. The pressure then elevates from an initial base pressure $P_o$ 636 to a peak value and then decays back to $P_o$ as the gas is evacuated from the chamber. The pressure within the ion-confining region, 205 of FIG. 2A, follows a similar trajectory. In various embodiments, the gas-injection duration is less than about 50 milliseconds (ms). In various embodiments, the gas injection duration is greater than about 50 ms for ions with masses exceeding about 30,000 Da, and less than about 50 ms for ions with masses less than about 5,000 Da.

In various embodiments, there are two aspects of the curve 610 relevant to time-efficient operation of the instrument: a duration that the pressure is above a pre-desired cooling pressure, $P_c$ 632, and a duration it takes for the pressure to recover from its peak value to a pre-desired operating pressure $P_d$ 634. The duration that the pressure is above the pre-desired cooling pressure can be depicted as the time interval between the lines 622 and 624. For time-efficient operation of the instrument in various embodiments, the duration that the pressure is above a pre-desired cooling pressure is chosen to substantially match the time required for the ions to lose a pre-desired amount of their excess kinetic energy. For example, in various embodiments the duration indicated by the interval between lines 622 and 624 of FIG. 6A can be chosen to be substantially equal to the amount of time during which the ion kinetic energy is about 15% greater than the ambient value, for example line 430*a* in FIG. 4A. Continuing with this example, the duration of pressure elevation would be about 30 ms.

The pressure-recovery duration, i.e., the time required for restoration of the pre-desired operating pressure $P_d$ 634, can be indicated by the time interval between the peak pressure value of the curve 610 in FIG. 6A and line 626. This recovery period represents, e.g., a post-injection delay after which pressure-sensitive detectors in the instrument are activated, ions ejected from the trap, etc. In various embodiments, it is desirable to minimize this delay as much as possible to avoid instrument idle time.

The pressure dynamics within the LIT were also studied by the inventors. The non-steady state pressure evolution in a chamber was represented by the equation $$P(t) = \frac{Q}{S}\left(1 - \exp\left(-\frac{S}{V}t\right)\right) + P_o \tag{3}$$

where P(t) is the pressure as a function of time, Q is the throughput of the injection nozzle, S is the pumping speed of the pump, V is the volume of the chamber, and $P_o$ is the background pressure of the chamber. When the valve, 230 in FIG. 2A, closes the pressure in the vacuum chamber can be described by the equation $$P(t) = (P_{off} - P_o) * \left(1 - \exp\left(-\frac{S}{V}t\right)\right) + P_o \tag{4}$$

where $P_{off}$ is the instantaneous pressure in the chamber at the time the valve closes.

Figure 6B:
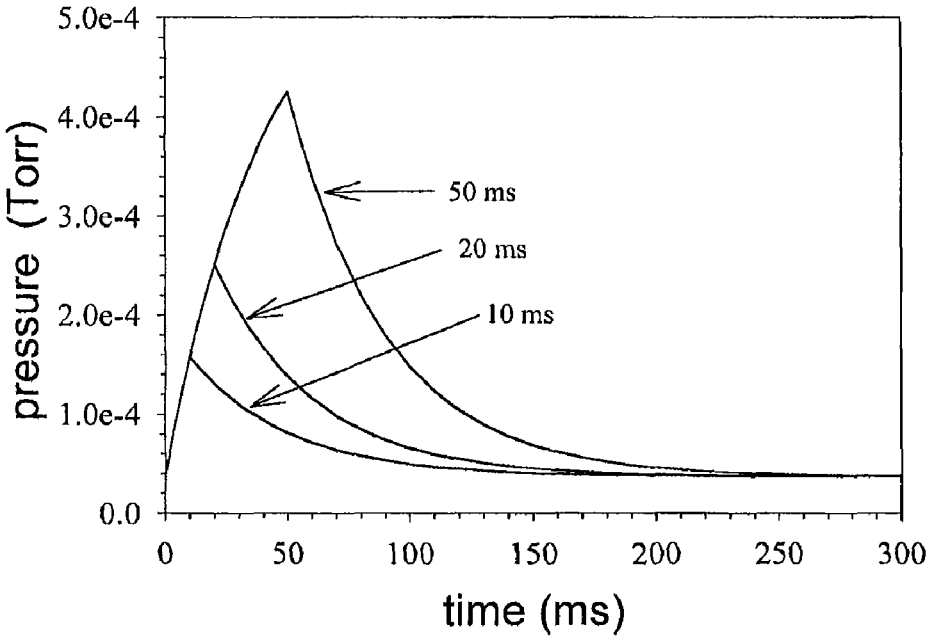
FIG. 6B is a plot comparing the non-steady-state pressure in a 10-liter chamber, evacuated at a rate of 250 liters/second, during and after gas injection from a nozzle, backed at 150 Torr, for three time periods: 10 ms, 20 ms, 50 ms.

Three pressure profiles, calculated according to Eqns. (3) and (4), are shown in FIG. 6B for the conditions of Q=0.136 Torr L/s, S=250 L/s, V=10 L and $P_o$=3.7×10$^{-5}$ Torr. The backing pressure on the nozzle was taken as 150 Torr. The three curves represent the predicted pressure profiles that would result if the pulsed valve 230 were held open for 10, 20 and 50 ms. A longer gas-injection duration results in a higher peak chamber pressure and a longer recovery time.

Figure 6C:
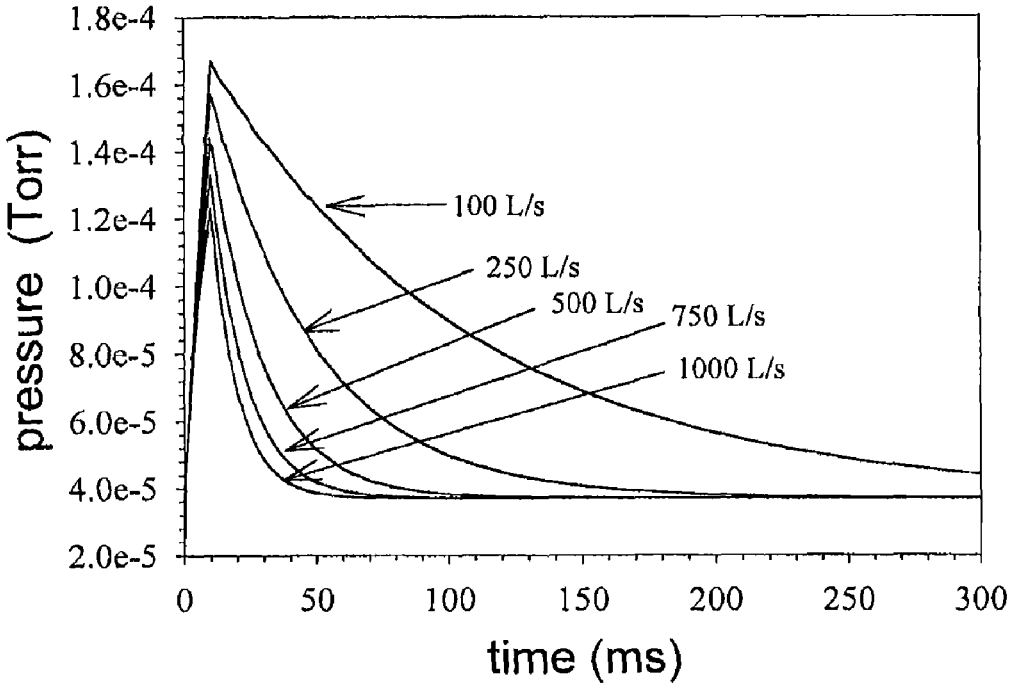
FIG. 6C is a plot comparing the non-steady-state pressure in a 10-liter chamber, during and after gas injection from a nozzle, backed at 150 Torr, for 10 ms at five rates of evacuation: 100 L/s, 250 L/s, 500 L/s, 750 L/s, 1000 L/s.
Figure 6D:
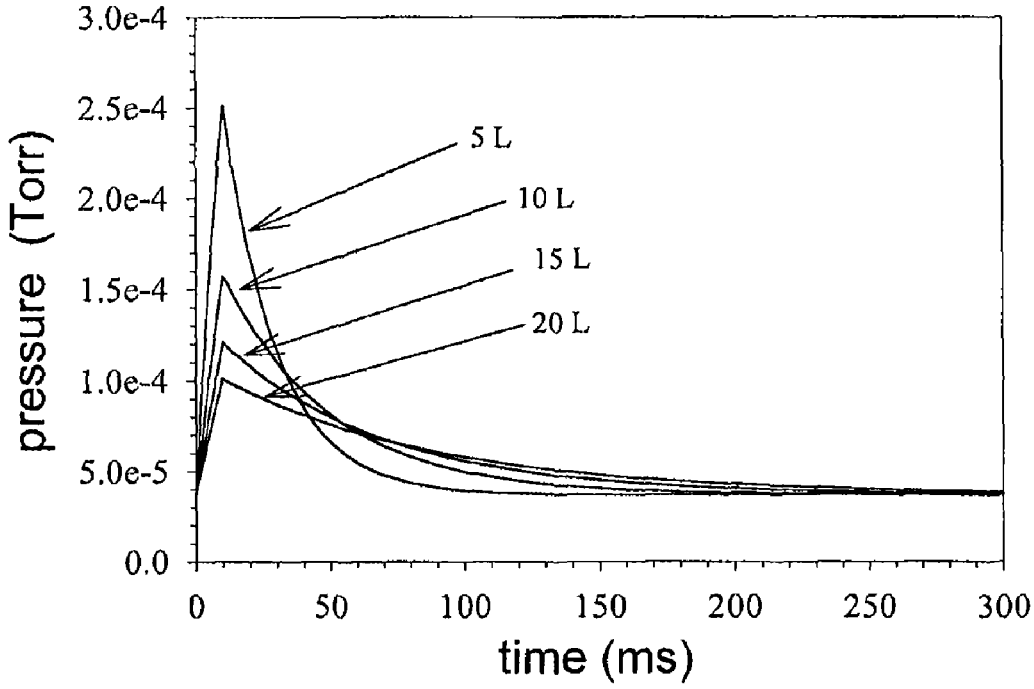
FIG. 6D is a plot comparing the non-steady-state pressure in chambers of four sizes, 5 L, 10 L, 15 L, 20 L, during and after gas injection from a nozzle, backed at 150 Torr, for 10 ms at an evacuation rate of 250 L/s.

FIGS. 6C-6D show the dependence of the pressure profiles on both pumping speed, FIG. 6C, and chamber volume, FIG. 6D. The chamber pressure recovers more quickly as the pumping speed is increased and the chamber's volume is decreased, and the pressure elevates more quickly for chambers having smaller volumes. For the conditions of FIG. 6C, the valve was held open for 10 ms, the backing pressure was 150 Torr, and the chamber's volume was set at 10 L. For the conditions of FIG. 6D, the valve was held open for 10 ms, the backing pressure was 150 Torr, and the pumping speed was set at 250 L/s.

Figure 6E:
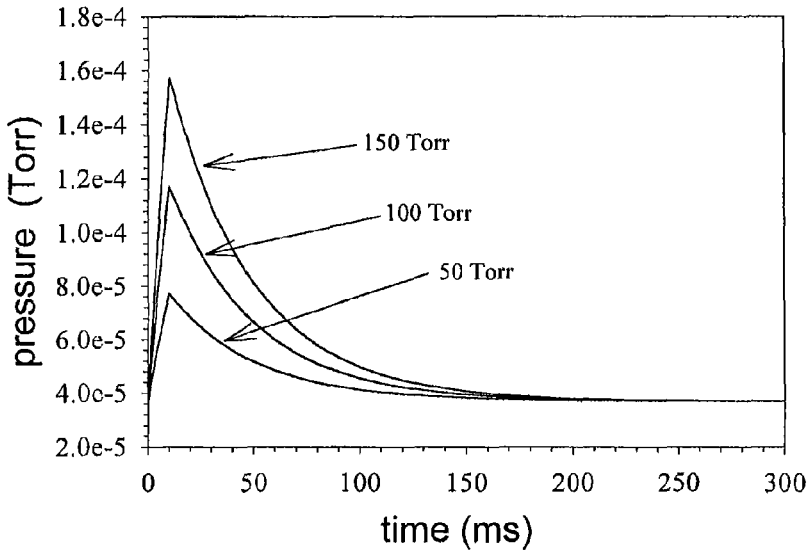
FIG. 6E is a plot comparing the non-steady-state pressure in a 10-liter chamber, during and after gas injection from a nozzle, backed at three different pressures P, for 10 ms at an evacuation rate of 250 L/s where: P=50 Torr, 100 Torr, 150 Torr.

The throughput of the gas-injection nozzle 230 can be a factor contributing to the shape of the pressure profiles. Throughput can be determined from a nozzle's orifice diameter and its backing pressure. FIG. 6E shows pressure profiles as a function of the nozzle's backing pressure. For this case, the valve was held open for 10 ms, the chamber volume was set at 10 L, and the pumping speed was 250 L/s.

From FIGS. 3A, 3B and FIGS. 6B-6E it can be seen that the pressure in the ion-confining region of the LIT region depends upon the location of the nozzle, the size of the nozzle's aperture, the backing pressure, pumping speed and chamber volume. In various embodiments, the geometry of the LIT rods and their gas conductance can also affect the time-varying and spatially-varying pressure profiles within the ion-confinement region 205. For example, in various embodiments the size of the quadrupole rods is used to determine how close the pulsed valve and nozzle are placed relative to the region where the ions are trapped 205.

Figure 7:
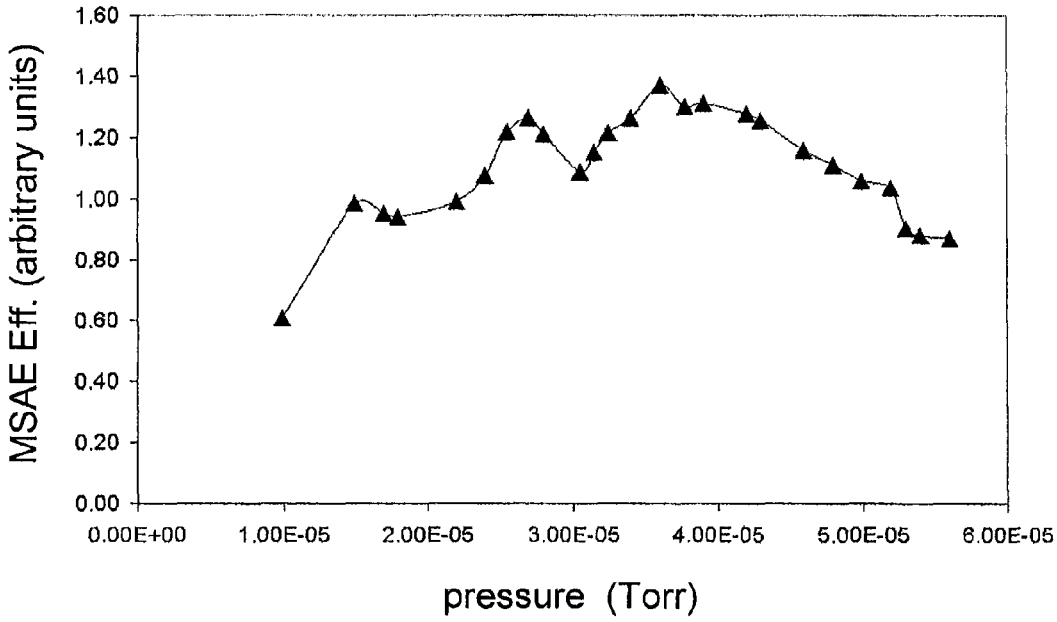
FIG. 7 is an experimentally-determined plot of the mass selective axial ejection (MSAE) efficiency as a function of pressure within the LIT.

In various embodiments, the pressure-recovery duration can be determined, for example, by the time required for restoration of a pressure $P_d$ within the instrument that permits safe operation of any pressure-sensitive components, efficient ejection of ions from the LIT, etc. In various experiments, ion ejection was performed using the method of mass selective axial ejection (MSAE). FIG. 7 is a plot of MSAE extraction efficiency as a function of LIT pressure. This data set shows that the extraction efficiency of the MSAE process is greater than about 30% at pressures greater than about 2×10$^{-5}$ Torr and up to about 5.5×10$^{-5}$ Torr. In various embodiments, the upper pressure limit for the purposes of MSAE can be the predominant factor determining the pressure-recovery duration. The amount of time required to pump the vacuum chamber back down to this pressure is a function, for example, of the gas load introduced into the chamber from the injection nozzle, the pumping speed of the pump used on the LIT chamber, and the volume of the vacuum chamber.

All literature and similar material cited in this application, including, but not limited to, patents, patent applications, articles, books, treatises, and web pages, regardless of the format of such literature and similar materials, are expressly incorporated by reference in their entirety. In the event that one or more of the incorporated literature and similar materials differs from or contradicts this application, including but not limited to defined terms, term usage, described techniques, or the like, this application controls.

The section headings used herein are for organizational purposes only and are not to be construed as limiting the subject matter described in any way.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art.

The claims should not be read as limited to the described order or elements unless stated to that effect. It should be understood that various changes in form and detail may be made by one of ordinary skill in the art without departing from the spirit and scope of the appended claims. All embodiments that come within the spirit and scope of the following claims and equivalents thereto are claimed.

What is claimed is:

1. A method for reducing the kinetic energy of ions in an ion-confinement apparatus, the method comprising the steps of:

retaining the ions in the ion-confinement apparatus for a retention time;

delivering a cooling gas into the ion-confinement apparatus during the retention time to raise the pressure in at least a portion of the ion confinement apparatus above a predesired cooling-gas pressure of about $8\times10^{-5}$ Torr for a predetermined duration that is less than the ion retention time;

creating for at least a portion of the retention time a non-steady state pressure in the ion-confinement apparatus; and ejecting the ions from the ion-confinement apparatus at the end of the retention time.

2. A method according to claim 1, wherein the ion-confinement apparatus comprises a quadrupole linear ion trap.

3. A method according to claim 2, wherein the pressure in the at least a portion of the ion confinement apparatus is raised above about $1.5\times10^{-4}$ Torr for the predetermined duration.

4. A method according to claim 2, wherein the pressure in the at least a portion of the ion confinement apparatus is in the range between about $8\times10^{-5}$ Torr and about $2.5\times10^{-4}$ Torr during the predetermined duration.

5. A method according to claim 2, wherein the predetermined duration is less than about 50 ms.

6. A method according to claim 2, wherein the predetermined duration is less than about 30 ms.

7. A method according to claim 2, wherein the predetermined duration is less than about 10 ms.

8. A method according to claim 2, wherein the predetermined duration is less than about 50 ms for ions having a mass in the range between about 5,000 Da and about 30,000 Da.

9. A method according to claim 2, wherein the predetermined duration is less than about 25 ms for ions having a mass in the range between about 500 Da and about 5,000 Da.

10. A method according to claim 2, wherein the predetermined duration is selected to be in the range between about 85% to about 115% of a first time period, comprising the time interval during which the mean kinetic energy for ions in the ion-confinement apparatus reduces to less than about 1% of the ions' peak mean-kinetic-energy value attained during the retention time within the ion-confinement apparatus.

11. A method according to claim 2, wherein the predetermined duration is selected to be in the range between about 85% to about 115% of a second time period, comprising the time interval during which the mean kinetic energy for the ions in the ion-confinement apparatus reduces to less than a value that is about 15% greater than the ambient value for the ions in the ion-confinement apparatus.

12. A method according to claim 2, wherein the cooling gas comprises one or more of the following: hydrogen, helium, nitrogen, argon, oxygen, xenon, krypton, and methane.

13. A method according to claim 2, wherein the pressure in the ion confinement apparatus is in the range between about $2\times10^{-5}$ Torr and $5.5\times10^{-5}$ Torr during the ejection of the ions from the linear ion trap.

14. A method according to claim 2, wherein the cooling gas is delivered from a high-speed pulsed valve.

15. A method according to claim 2, wherein the cooling gas is delivered from plural high-speed pulsed valves.

16. A method according to claim 2 including mass analyzing the ions ejected from the ion-confinement apparatus to generate a mass spectrum.

* * * * *